US010041728B2

(12) United States Patent
Go et al.

(10) Patent No.: US 10,041,728 B2
(45) Date of Patent: Aug. 7, 2018

(54) REFRIGERATOR

(71) Applicant: SAMSUNG ELECTRONICS CO., LTD., Suwon-si, Gyeonggi-do (KR)

(72) Inventors: Hyoung Min Go, Gwangju (KR); Sung Cheul Park, Gwangju (KR); Won Jae Choi, Gwangju (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 14/915,920

(22) PCT Filed: Sep. 1, 2014

(86) PCT No.: PCT/KR2014/008134

§ 371 (c)(1),
(2) Date: Mar. 2, 2016

(87) PCT Pub. No.: WO2015/030546

PCT Pub. Date: Mar. 5, 2015

(65) Prior Publication Data

US 2016/0216027 A1 Jul. 28, 2016

(30) Foreign Application Priority Data

Sep. 2, 2013 (KR) ..... 10-2013-0105109

(51) Int. Cl.
*A47B 95/00* (2006.01)
*F25D 25/02* (2006.01)
(Continued)

(52) U.S. Cl.
CPC ..... *F25D 25/024* (2013.01); *A47B 88/467* (2017.01); *F25D 23/067* (2013.01); *F25D 25/025* (2013.01); *F25D 29/006* (2013.01)

(58) Field of Classification Search
CPC ..... A47B 88/047; A47B 88/467; A47B 2088/4675
(Continued)

(56) References Cited

U.S. PATENT DOCUMENTS 4,285,560 A * 8/1981 Miller ..... A47B 88/493 108/83
7,374,260 B2 * 5/2008 Lu ..... A47B 88/467 312/319.1
(Continued)

FOREIGN PATENT DOCUMENTS

CN 100434018 11/2008
CN 102414525 4/2012
(Continued)

OTHER PUBLICATIONS

International Search Report dated Dec. 11, 2014, in corresponding International Application No. PCT/KR2014/008134.
(Continued)

*Primary Examiner* — Matthew W Ing
(74) *Attorney, Agent, or Firm* — Staas & Halsey LLP

(57) ABSTRACT

A refrigerator in which a storage box can be sufficiently drawn by placing a sliding shelf at the bottom of the storage box, and the storage box is easily inserted when it is inserted into inside the storage chamber, and less noise is generated, is provided. The refrigerator includes a storage box received in a storage chamber and inserted and drawn by sliding, a sliding shelf combined with a lower portion of the storage box and configured to guide the storage box to be inserted and drawn, and a combining unit provided at both sidewalls of the storage chamber to be combined with the sliding shelf, and the sliding shelf includes a sliding part combined with the lower portion of the storage box, a cover rail combined with the combining unit and guiding the storage box to be inserted and drawn by sliding, a slide rail provided at the
(Continued)

sliding part to slide along the cover rail, and a self-closing unit combined with the sliding part, configured to accumulate an elastic force when the storage box is drawn and transfer the elastic force in a direction in which the storage box is inserted into the storage chamber when the storage box is inserted, and provided with an oil damper which absorbs a shock, which is generated by the elastic force when the storage box is inserted, is provided.

34 Claims, 11 Drawing Sheets

(51) Int. Cl.
*A47B 88/467* (2017.01)
*F25D 23/06* (2006.01)
*F25D 29/00* (2006.01)

(58) Field of Classification Search
USPC ..... 312/333, 319.1, 330.1, 334.6, 334.27, 312/334.32, 402, 404
See application file for complete search history.

(56) References Cited

U.S. PATENT DOCUMENTS

| | | | | |
|---|---|---|---|---|
| 8,282,177 | B1 | 10/2012 | Rotter | |
| 9,702,613 | B2 * | 7/2017 | Yoo | E05D 15/04 |
| 9,756,940 | B2 * | 9/2017 | Chen | A47B 88/467 |
| 9,820,573 | B2 * | 11/2017 | Brunnmayr | A47B 88/40 |
| 9,863,692 | B2 * | 1/2018 | Moon | F25D 25/025 |
| 2002/0033658 | A1 * | 3/2002 | Salice | E05F 5/027 312/334.14 |
| 2004/0056573 | A1 * | 3/2004 | Chae | F25D 25/025 312/404 |
| 2006/0022564 | A1 | 2/2006 | Oh et al. | |
| 2006/0033410 | A1 * | 2/2006 | Koons | F25D 23/021 312/404 |
| 2007/0132346 | A1 * | 6/2007 | Huang | A47B 88/467 312/333 |
| 2011/0095670 | A1 * | 4/2011 | Cho | F25D 25/025 312/405.1 |
| 2012/0306338 | A1 * | 12/2012 | Nagahata | F25D 23/067 312/405.1 |
| 2014/0021841 | A1 * | 1/2014 | Brunnmayr | A47B 88/0477 312/319.1 |
| 2014/0265800 | A1 * | 9/2014 | Haltmeyer | F25D 25/025 312/404 |
| 2018/0055225 | A1 * | 3/2018 | Chen | A47B 88/49 |

FOREIGN PATENT DOCUMENTS

| | | | | |
|---|---|---|---|---|
| DE | 202012003005 U1 * | 6/2013 | | A47B 88/00 |
| EP | 1541057 | 6/2005 | | |
| KR | 10-2006-0011221 | 2/2006 | | |
| KR | 10-2007-0075671 | 7/2007 | | |
| KR | 10-2010-0116767 | 11/2010 | | |
| KR | 10-2011-0016805 | 2/2011 | | |
| KR | 10-2011-0046237 | 5/2011 | | |
| WO | WO-2014032063 A1 * | 3/2014 | | A47B 88/467 |

OTHER PUBLICATIONS

Chinese Office Action dated Apr. 28, 2017 in Chinese Patent Application No. 201480048200.2.
Extended European Search Report dated Mar. 15, 2017 in European Patent Application No. 14838999.2.
Korean Office Action dated Aug. 15, 2017 in Korean Patent Application No. 10-2013-0105109.
Chinese Decision on Grant dated Oct. 26, 2017 in Chinese Patent Application No. 201480048200.2.
Korean Office Action dated Feb. 26, 2018 in Korean Patent Application No. 10-2013-0105109.

* cited by examiner

[Fig. 1]
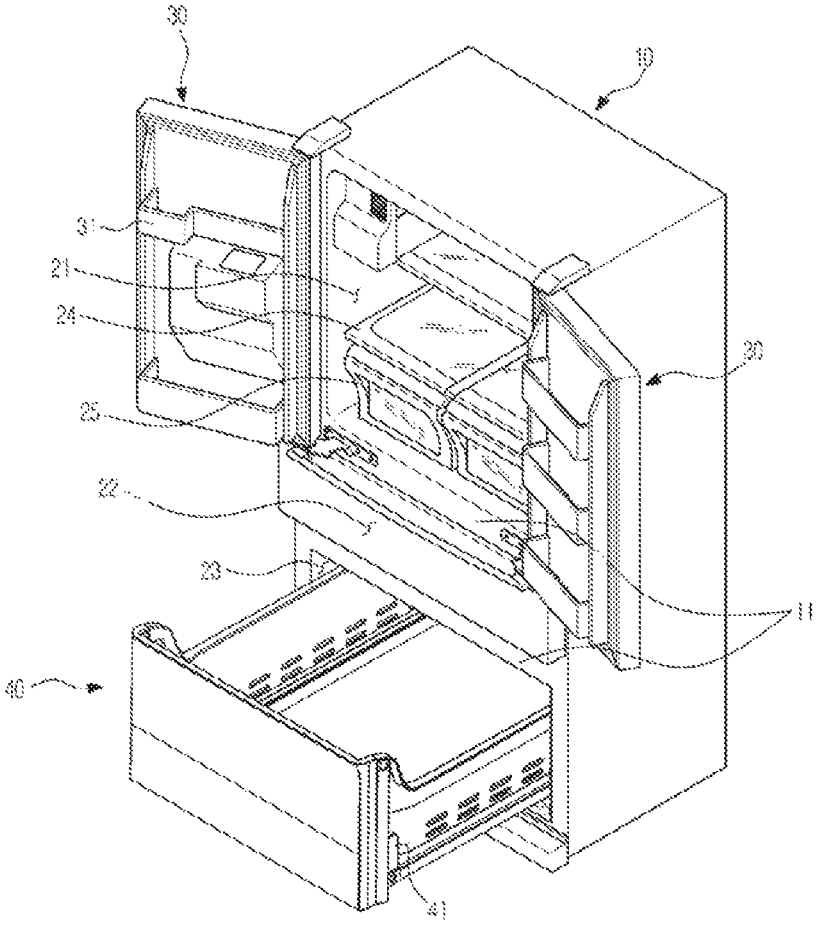

[Fig. 2]
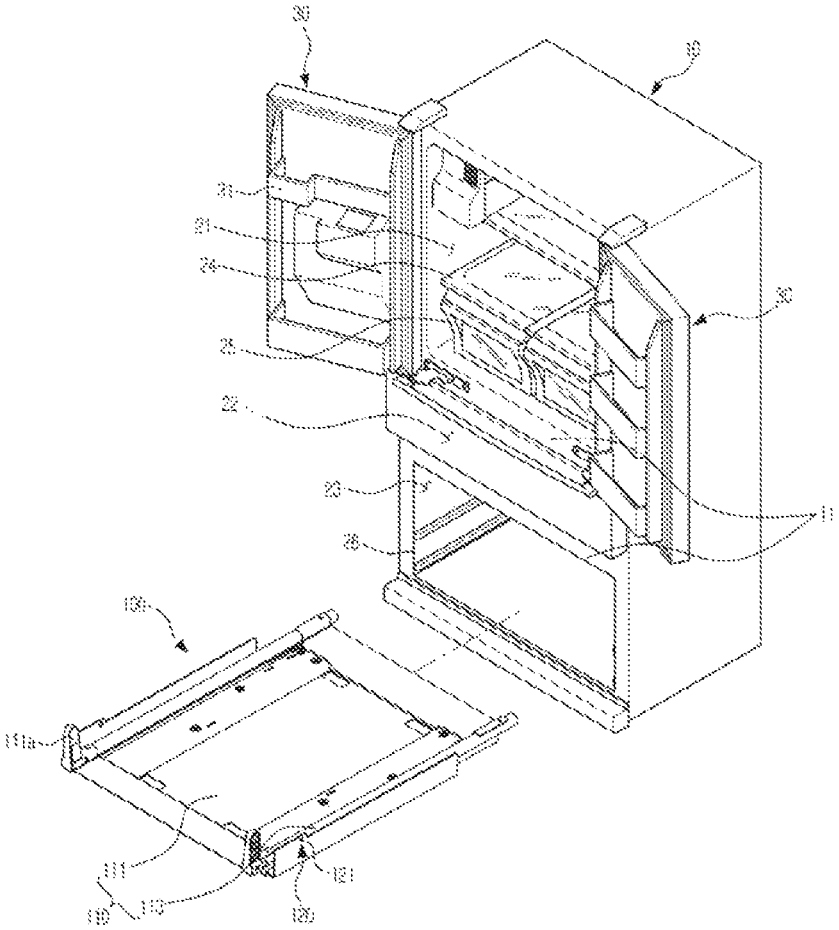

[Fig. 3]
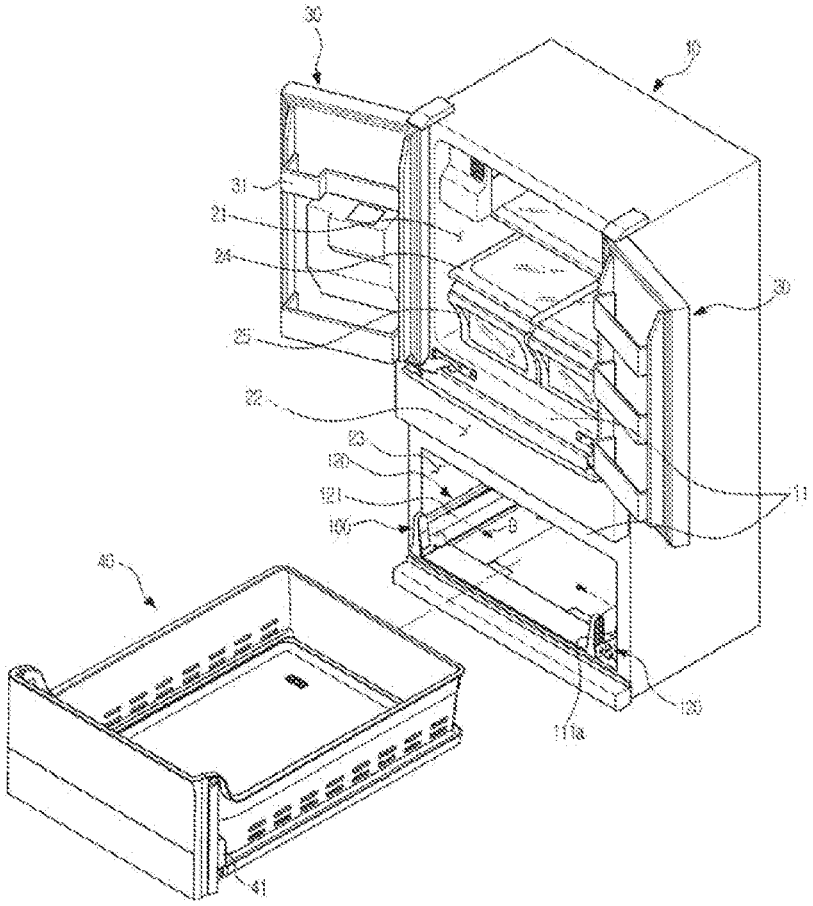
[Fig. 4]
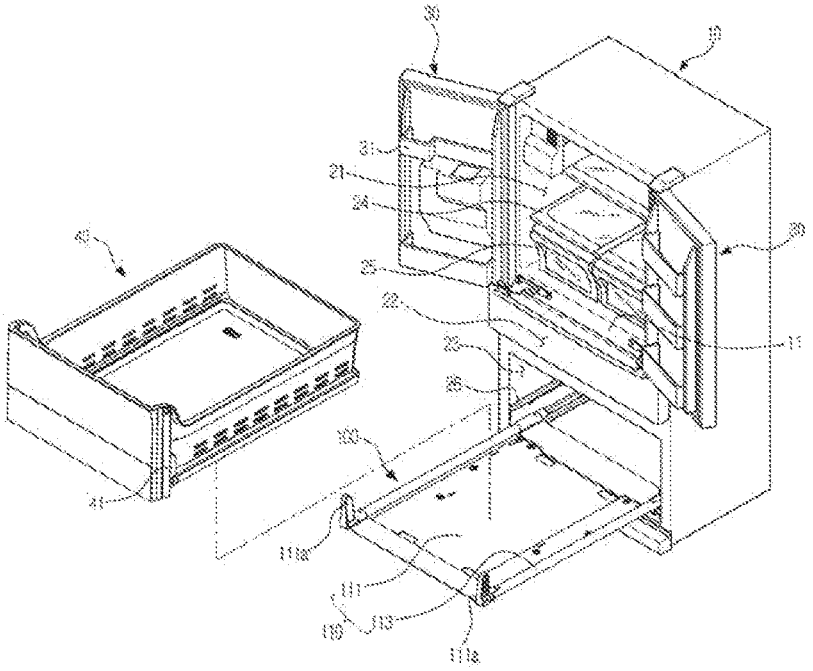

[Fig. 5]
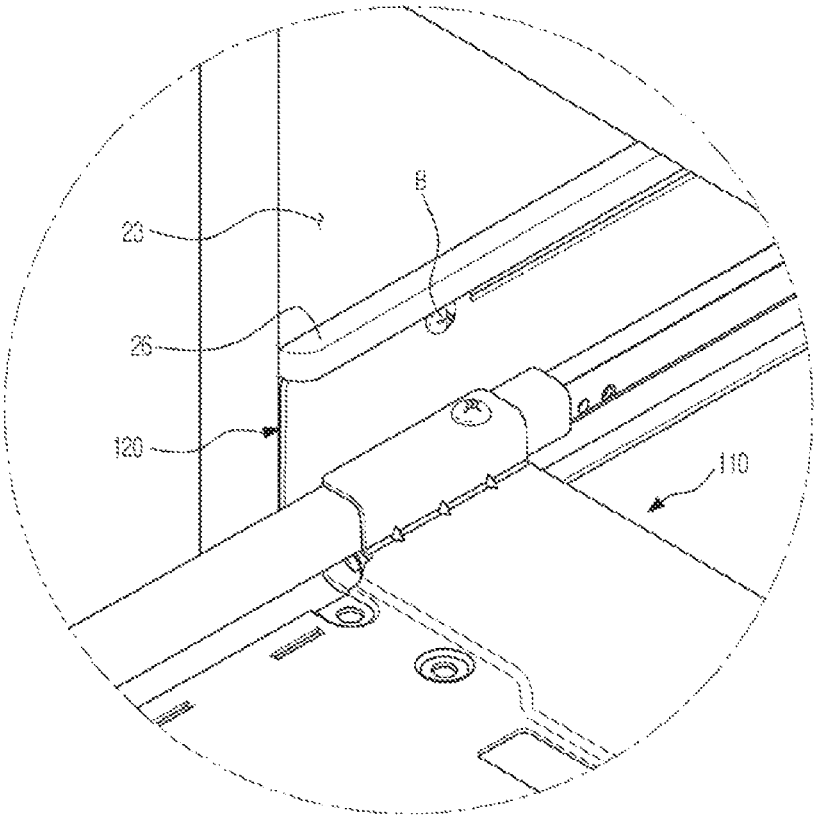
[Fig. 6]
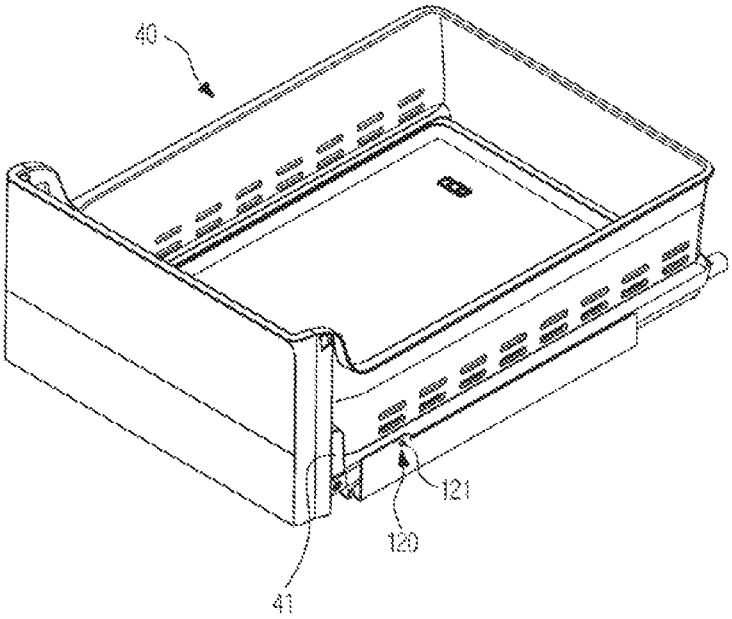

[Fig. 7]
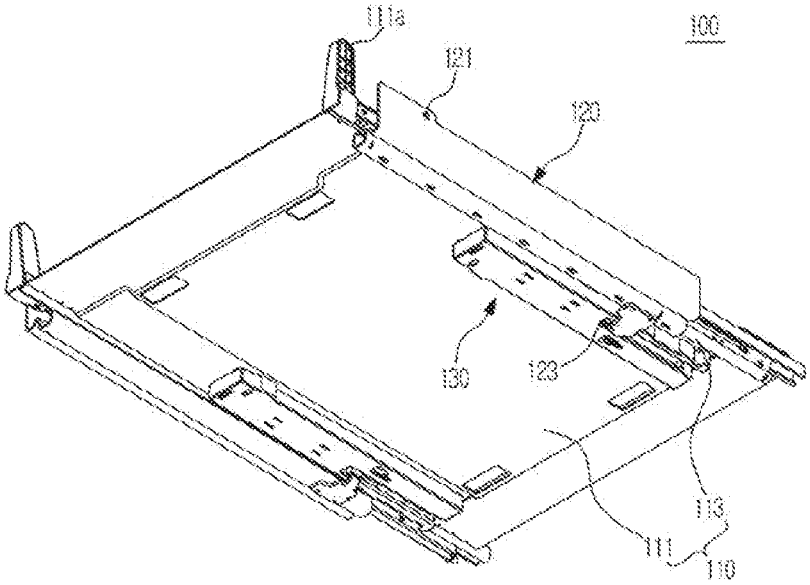
[Fig. 8]
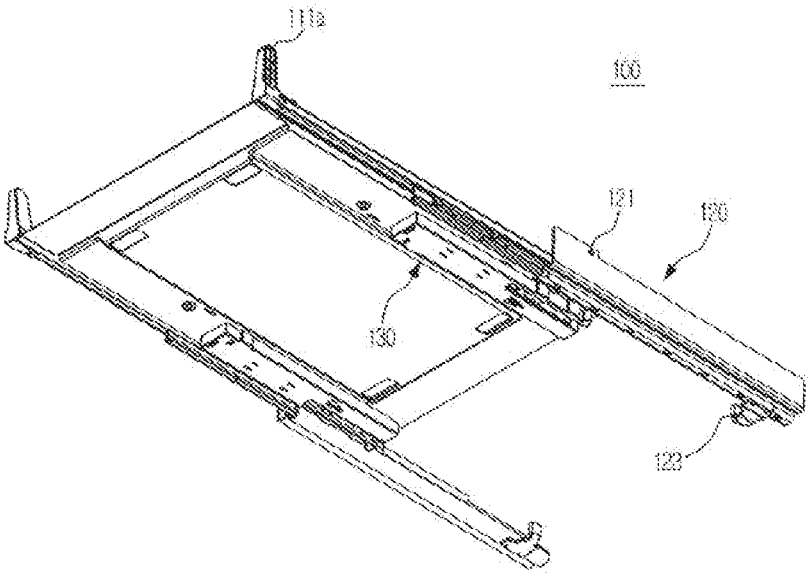

[Fig. 9]
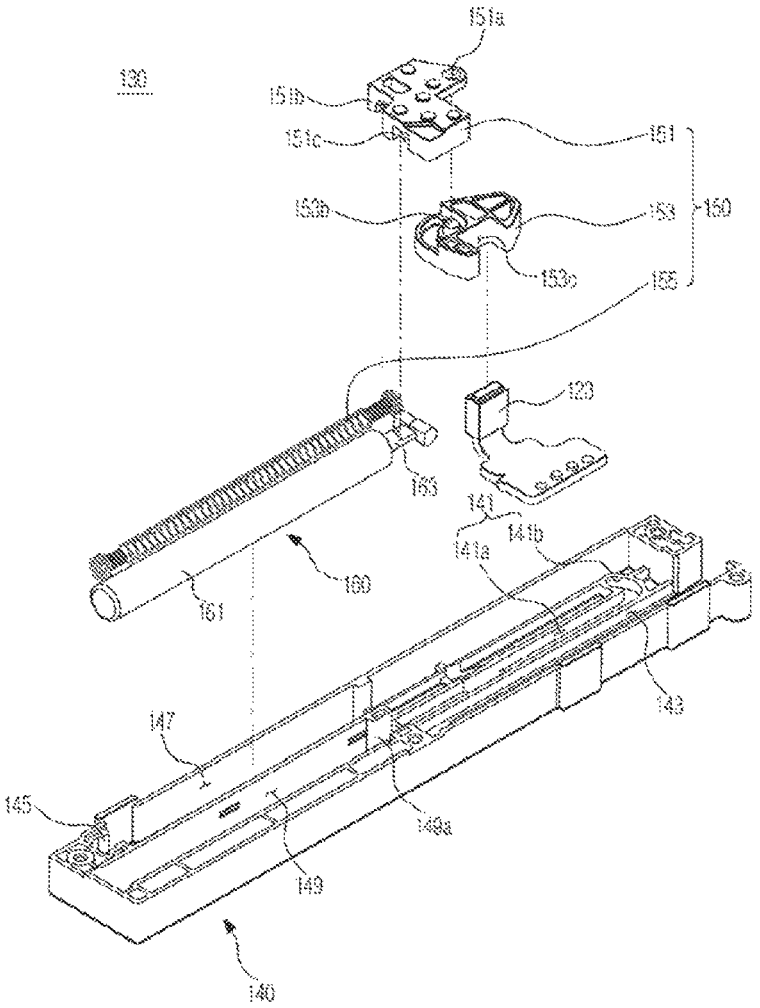
[Fig. 10]
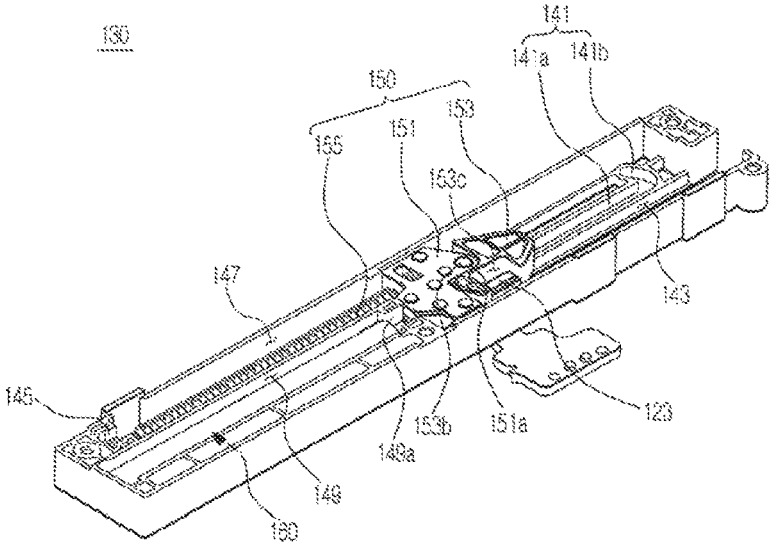

[Fig. 11]
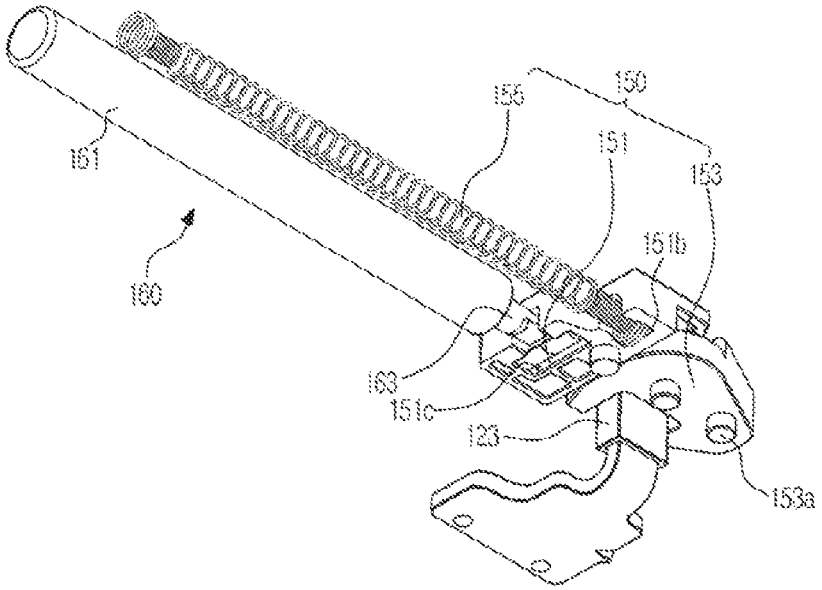

[Fig. 12]
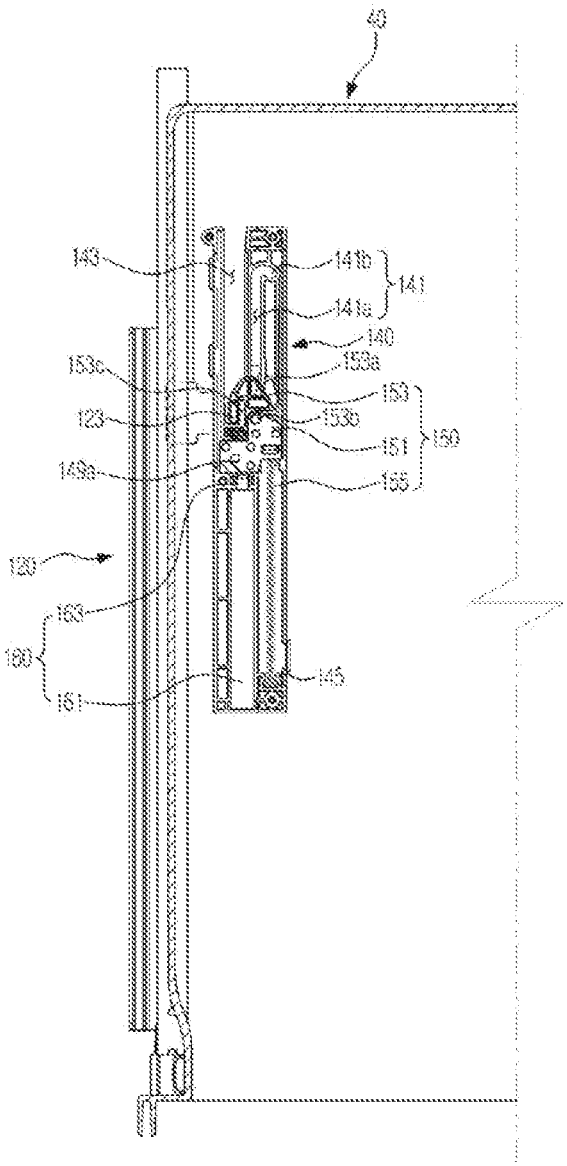

[Fig. 13]
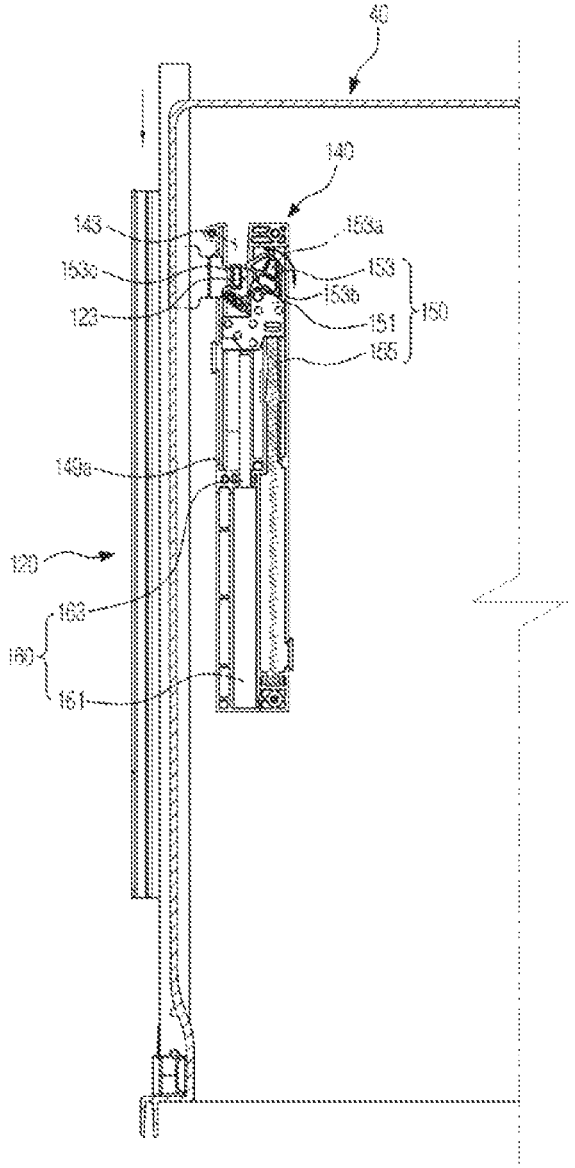

[Fig. 14]
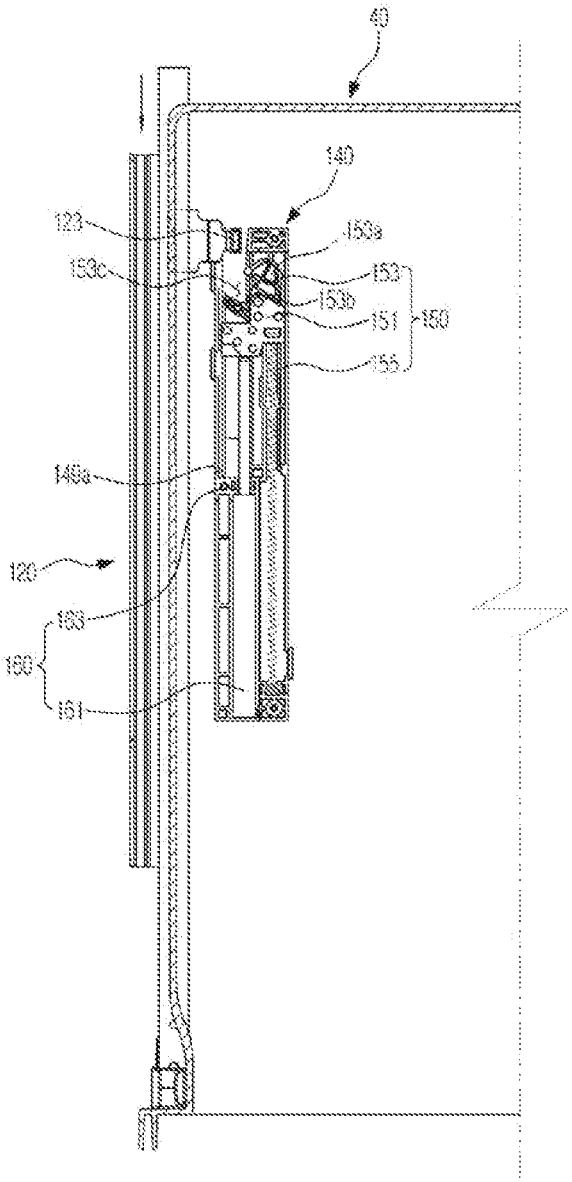

[Fig. 15]
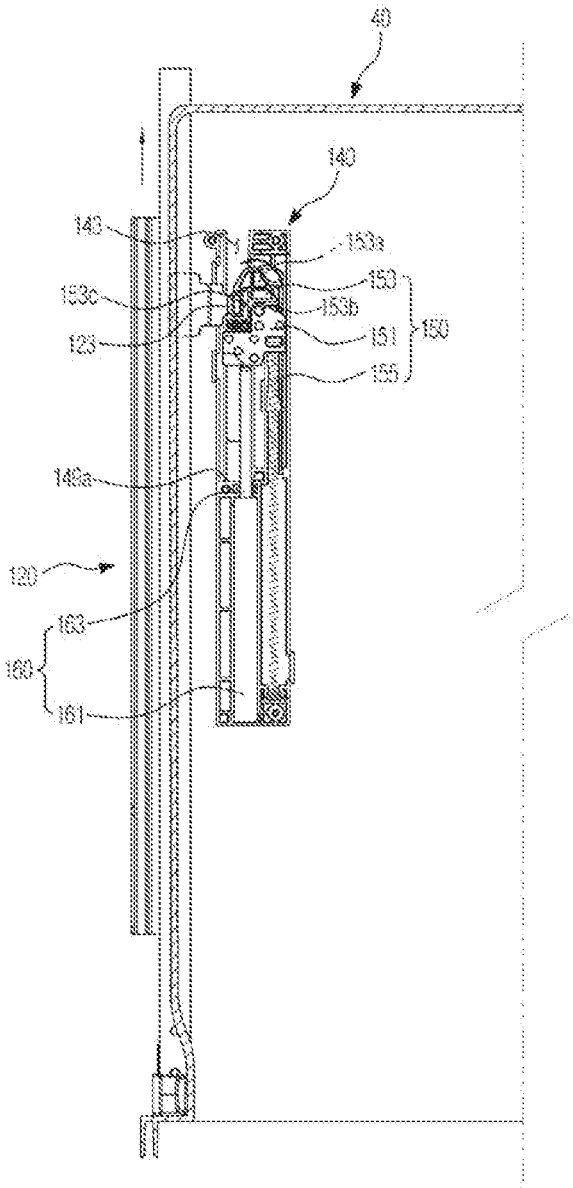

REFRIGERATOR

CROSS-REFERENCE TO RELATED APPLICATIONS

This application is a U.S. National Stage Application, which claims the benefit under 35 U.S.C. § 371 of PCT International Patent Application No. PCT/KR2014/008134, filed Sep. 1, 2014, which claims the foreign priority benefit under 35 U.S.C. § 119 of Korean Patent Application No. 10-2013-0105109, filed Sep. 2, 2013, the contents of which are incorporated herein by reference.

TECHNICAL FIELD

The present invention relates to a refrigerator having a storage unit which is inserted and drawn by a sliding shelf.

BACKGROUND ART

Generally, a refrigerator includes storage chambers and a cold air supply apparatus for supplying cold air to the storage chambers to keep food fresh.

The insides of the storage chambers maintain temperatures, each of which is within a designated range, required to store food in a fresh state.

Front surfaces of such storage chambers of the refrigerator are opened, and the opened front surfaces are closed by doors to maintain the temperatures of the insides of the storage chambers at normal times.

The storage chambers are divided into a plurality of chambers by partitions, and among the plurality of storage chambers, a storage chamber provided at an upper side is opened and closed by two doors rotatably hinged and another storage chamber provided at the lower side is opened and closed by a storage box sliding in forward and backward directions.

The storage box is inserted into and drawn from the storage chamber by a sliding unit in a sliding manner, and the sliding unit includes a cover rail provided at both sidewalls of the storage chamber and slide rails provided at an outside of both side surfaces of the storage box to be guided along the cover rail.

Since this constitution, in which a rail structure of the sliding unit is provided at the side surfaces of the storage box, is operated by installing a roller at the side surfaces of the storage box, the distance of the storage box to be drawn is shortened such that food inside the storage box is difficult to take.

Additionally, a user needs to push the storage box until an end to sufficiently insert the storage box when the storage box is inserted inside the storage chamber, and noise is caused while the storage box is inserted.

DISCLOSURE

Technical Problem

One aspect of the present invention provides a refrigerator in which a storage box can be sufficiently drawn by placing a sliding shelf at the bottom of the storage box.

Additionally, a refrigerator, in which when a storage box is inserted inside a storage chamber, the storage box is easily inserted, and less noise is generated, is provided.

Technical Solution

A refrigerator according to one embodiment of the present invention includes a main body, a storage chamber provided inside the main body such that a front surface is open, a storage box received in the storage chamber and inserted and drawn by sliding, a sliding shelf combined with a lower portion of the storage box and guiding the storage box to be inserted and drawn, and combining unit provided at both sidewalls of the storage chamber to be combined with the sliding shelf, wherein the sliding shelf includes a sliding part combined with the lower portion of the storage box, a cover rail combined with the combining unit and configured to guide the storage box to be inserted and drawn by sliding, a slide rail provided at the sliding part to slide along the cover rail, and a self-closing unit combined with the sliding part, configured to accumulate an elastic force when the storage box is drawn and transfer an elastic force in a direction in which the storage box is inserted when the storage box is inserted, and provided with an oil damper which absorbs a shock which is generated by an elastic force when the storage box is inserted.

The combining unit may be integrally provided at both sidewalls of the storage chamber such that the cover rail is fitted into the combining unit by sliding.

The cover rail may include a fastening hole into which a fastening member is fitted such that the cover rail is fastened to the combining unit by the fastening member after the cover rail is inserted into the combining unit.

A combining protrusion which protrudes upwardly may be provided at an upper portion of both sides of a front of the sliding part for a combination of the storage box and the sliding part, and a combining groove, into which the combining protrusion is inserted, may be provided at a position corresponding to the combining protrusion at the storage box.

The storage box may be combined with an upper portion of the sliding part after the cover rail is combined with the combining unit.

The self-closing unit may include a case separately provided at both sides of a lower portion of the sliding part and configured to form an exterior, an elastic unit which is provided inside the case and accumulates an elastic force when the storage box is drawn and transfers the elastic force in the direction in which the storage box is inserted into the storage chamber when the storage box is inserted, and the oil damper combined with the elastic unit.

The elastic unit may include a slider moved linearly inside the case, a rotator rotatably combined with the slider, and an elastic member of which both ends are respectively combined with the slider and the case.

The cover rail may be provided with a locking member which is locked to the rotator when the storage box is inserted or drawn such that the rotator is moved linearly in the same direction as a moving direction of the storage box.

A fixer of which one end of the elastic member is fixed, a first receiving part in which the elastic member is received, a second receiving part in which the oil damper is received, a guide rail which guides the rotator, and a guide part which is provided to be parallel with the guide rail and guides the locking member to be moved linearly may be provided inside the case.

The guide rail may include a straight route which guides the rotator to be moved linearly in forward and backward directions, and a locking part which is provided at one end of the straight route such that the rotator is rotated and fixed.

The rotator may include a protrusion which protrudes toward the guide rail and is received in the guide rail such that the rotator is guided along the guide rail, a rotation axis which allows the rotator to be rotatably combined with the slider, and a locking groove which is provided so as to receive and lock the locking member.

The slider may include a rotation hole in which the rotation axis is rotatably combined, a first fixing groove in which the elastic member is fixed, and a second fixing groove in which the oil damper is fixed.

The oil damper may include a body part an inside of which is filled with oil and which is received in the second receiving part, and a moving unit which is received inside the body part, fixed at the second fixing groove and moved linearly together with the slider, and inserted into and drawn from the body part, wherein a locking tab is provided in the second receiving part so as to fix the body part to prevent a movement of the body part.

The self-closing unit may be moved together with the storage box in a direction in which the storage box is drawn from the storage chamber and the rotator may be locked to the locking member and moved along the straight route such that the elastic member is stretched, during a process of removing the storage box.

The rotator may be moved along the straight route together with the slider and rotates around the rotation axis to be locked to the locking part, the elastic member may maintain a stretched state when the rotator is locked and fixed at the locking part, and the locking member may be moved along the guide part such that the storage box is completely drawn while the locking member is separated from the locking groove.

The self-closing unit may be moved together with the storage box in the direction in which the storage box is inserted into the storage chamber and the rotator may be locked to the locking member while the locking member is moved along the guide part such that the rotator is rotated around the rotation axis and is released from the locking part, during a process of inserting the storage box.

The rotator may be moved along the straight route, and the elastic force of the elastic member may be transferred to the storage box in the direction in which the storage box is inserted into the storage chamber such that the storage box is inserted, when the rotator is released from the locking part.

The oil damper absorbs a shock which is generated when the storage box is inserted in such a manner that the moving unit fixed to the slider is moved together with the slider and drawn to an outside of the body part when the storage box is drawn, and the moving unit is moved together with the slider and inserted into the body part when the storage box is inserted.

Additionally, a refrigerator according to one embodiment of the present invention includes a main body, a storage chamber provided inside the main body such that a front surface is open, a storage box received in the storage chamber, a cover rail combined with both sidewalls of the storage chamber and guiding the storage box to be inserted and drawn by sliding, a slide unit combined with a lower portion of the storage box to slide along the cover rail, and a self-closing unit which is combined with the slide unit and transfers an elastic force in a direction in which the storage box is inserted into the storage chamber, wherein the self-closing unit includes an elastic unit which accumulates an elastic force when the storage box is drawn, and an oil damper which accumulates a damping force when the elastic unit accumulates the elastic force, and the accumulated elastic force and damping force act on the storage box at the same time when the storage box is inserted such that the storage box is inserted by the elastic force and a shock, which is generated on the storage box when the storage box is inserted, is absorbed by the damping force.

The slide unit may include a sliding part combined with the lower portion of the storage box, and a slide rail provided in the sliding part to slide along the cover rail.

The self-closing unit may further include a case separately provided at both sides of a lower portion of the sliding part and forming an exterior, and the elastic unit and the oil damper may be received inside the case.

The elastic unit may include a slider moved linearly inside the case, a rotator rotatably combined with the slider, and an elastic member of which both ends are respectively combined with the slider and the case.

The cover rail is provided with a locking member which is locked to the rotator when the storage box is inserted or drawn such that the rotator is moved linearly in the same direction as a moving direction of the storage box.

A fixer of which one end of the elastic member is fixed, a first receiving part in which the elastic member is received, a second receiving part in which the oil damper is received, a guide rail which guides the rotator, and a guide part which is provided to be parallel with the guide rail and guides the locking member to be moved linearly may be provided inside the case.

The guide rail may include a straight route which guides the rotator to be moved linearly in forward and backward directions, and a locking part which is provided at one end of the straight route such that the rotator is rotated and fixed.

The rotator may include a protrusion which protrudes toward the guide rail and is received in the guide rail such that the rotator is guided along the guide rail, a rotation axis which allows the rotator to be rotatably combined with the slider, and a locking groove which is provided so as to receive and lock the locking member.

The slider may include a rotation hole in which the rotation axis is rotatably combined, a first fixing groove in which the elastic member is fixed, and a second fixing groove in which the oil damper is fixed.

The oil damper may include a body part an inside of which is filled with oil and which is received in the second receiving part, and a moving unit which is received inside the body part, fixed at the second fixing groove and moved linearly together with the slider, and inserted into and drawn from the body part, wherein a locking tab is provided in the second receiving part so as to fix the body part to prevent a movement of the body part.

The self-closing unit may be moved together with the storage box in a direction in which the storage box is drawn from the storage chamber and the rotator may be locked to the locking member and moved along the straight route such that the elastic member is stretched, during a process of removing the storage box.

The rotator may be moved along the straight route together with the slider and rotates around the rotation axis to be locked to the locking part, the elastic member may maintain a stretched state when the rotator is locked and fixed at the locking part, and the locking member may be moved along the guide part such that the storage box is completely drawn while the locking member is separated from the locking groove.

The self-closing unit may be moved together with the storage box in the direction in which the storage box is inserted into the storage chamber and the rotator may be locked to the locking member while the locking member is moved along the guide part such that the rotator is rotated around the rotation axis and is released from the locking part, during a process of inserting the storage box.

The rotator may be moved along the straight route and an elastic force of the elastic member may be transferred to the storage box in the direction in which the storage box is inserted into the storage chamber such that the storage box is inserted, when the rotator is released from the locking part.

The oil damper absorbs a shock which is generated when the storage box is inserted in such a manner that the moving unit fixed to the slider is moved together with the slider and drawn to an outside of the body part when the storage box is drawn, and the moving unit may be moved with the slider and inserted into the body part when the storage box is inserted.

Additionally, a refrigerator according to one embodiment of the present invention includes a main body, a storage chamber provided inside the main body such that a front surface is open, a storage box received in the storage chamber, a cover rail combined with both sidewalls of the storage chamber and guiding the storage box to be inserted and drawn by sliding, and in which a locking member is provided, a slide unit combined with a lower portion of the storage box to slide along the cover rail, an elastic unit which is combined with the slide unit, and in which a locking groove, which is locked to the locking member when the storage box is inserted or drawn, is provided to accumulate an elastic force when the locking member is locked to the locking groove while the storage box is drawn, and to transfer the elastic force to the storage box when the locking member is locked to the locking groove while the storage box is inserted, and an oil damper, which accumulates a damping force when the elastic unit accumulates the elastic force and absorbs a shock, which is generated on the storage box by the elastic force, using the accumulated damping force when the elastic unit transfers the elastic force to the storage box.

Advantageous Effects

According to embodiments of the present invention, a storage box is sufficiently drawn such that food stored inside the storage box can easily be taken out.

Additionally, the storage box is easily inserted with only a small force, and a shock which is generated by an elastic force when the storage box is inserted is absorbed such that noise can be decreased, and a rapid movement by the elastic force can be prevented.

DESCRIPTION OF DRAWINGS

FIG. 1 is a perspective view of a refrigerator according to one embodiment of the present invention.

FIG. 2 is a view illustrating a sliding shelf which is combined inside a storage chamber according to one embodiment of the present invention.

FIG. 3 is a view illustrating the sliding shelf which is combined inside the storage chamber according to one embodiment of the present invention.

FIG. 4 is a view illustrating a storage box which is combined with the sliding shelf according to one embodiment of the present invention.

FIG. 5 is an expanded view illustrating a cover rail of FIG. 4 which is combined with a combining unit.

FIG. 6 is a view illustrating the sliding shelf which is combined with a storage unit according to one embodiment of the present invention.

FIG. 7 is a view illustrating the sliding shelf according to one embodiment of the present invention, when viewed from bottom.

FIG. 8 is a view illustrating a sliding part which is drawn from the sliding shelf of FIG. 7.

FIG. 9 is an exploded perspective view of a self-closing unit according to one embodiment of the present invention.

FIG. 10 is a view illustrating a self-closing unit according to one embodiment of the present invention.

FIG. 11 is a view illustrating a part of the self-closing unit according to one embodiment of the present invention as seen from the bottom.

FIG. 12 is a view illustrating a state of the storage box which is inserted into the storage chamber according to one embodiment of the present invention.

FIG. 13 and FIG. 14 are views illustrating a drawing operation of the storage box according to one embodiment of the present invention.

FIG. 15 is a view illustrating an inserting operation of the storage box according to one embodiment of the present invention.

MODES OF THE INVENTION

Hereinafter, a detailed description will be given according to embodiments of the present invention referring to the accompanying drawings.

As illustrated in FIGS. 1 to 8, a refrigerator includes a main body 10, a plurality of storage chambers 20, each of which has an opened front surface, provided in the main body 10, doors 30 rotatably combined with the main body 10 so as to open and close the opened front surface of the storage chambers 20, storage boxes 40 which are received within the storage chambers 20 by being inserted thereinto and drawn therefrom by sliding, and sliding shelves 100 guiding the storage boxes 40 to be inserted and drawn by sliding.

The main body 10 includes an inner case (not shown) forming the storage chambers 20, an outer case (not shown) forming an exterior, and a cold air supply apparatus (not shown) supplying cold air to the storage chambers 20.

The cold air supply apparatus may include a compressor, a condenser, an expansion valve, an evaporator, an air blower fan and a cold air duct, etc., and a thermal insulating material (not shown) is provided between the inner case and the outer case of the main body 10 so as to prevent cold air leakage.

The storage chambers 20 may be divided into a plurality of chambers by partitions 11, that is, may be divided into an upper storage chamber 21, a middle storage chamber 22 and a lower storage chamber 23 disposed sequentially in a downward direction, and each storage chamber may store food in a refrigerated state or a frozen state, as needed.

Multiple shelves 24 may be provided within the upper storage chamber 21 to divide the upper storage chamber 21 into a plurality of chambers, and a plurality of storage containers 25 in which food, etc. can be stored may be provided within the upper storage chamber 21.

The upper storage chamber 21 may be opened and closed by the doors 30 rotatably combined with the main body 10, and the middle storage chamber 22 and the lower storage chamber 23 may be opened and closed by the storage boxes 40 slidable with respect to the main body 10.

A plurality of door guards 31 receiving foods, etc. may be installed on rear surfaces of the doors 30.

The storage boxes 40 are inserted into and drawn from the middle storage chamber 22 and the lower storage chamber 25 in a sliding manner by the sliding shelves 100.

For convenience, the storage box 40 inserted into and drawn from the lower storage chamber 23 will be exemplarily explained, and the sliding shelf 100 inserted into and drawn from the lower storage chamber 23 and combined with the storage box 40 will be exemplarily explained.

The sliding shelf 100 is combined with a lower portion of the storage box 40 so that the storage box 40 is inserted into and draws from the storage chamber 20.

Combining units 26 may be provided at both sidewalls of the storage chamber 20 for combining with a cover rail 120, and the combining unit 26 may be integrally provided at both sidewalls of the storage chamber 20.

The combining unit 26 is provided so that the cover rail 120 may be inserted by sliding.

Regarding to a process of installing the sliding shelf 100, firstly the cover rail 120 of the sliding shelf 100 is pushed into the combining unit 26 by sliding, and a fastening member B is inserted into a fastening hole 121 provided at the cover rail 120 such that the cover rail 120 is combined with the combining unit 26.

When the cover rail 120 is combined with the combining unit 26, a slide unit 110 is drawn to the outside of the storage chamber 20, and then the storage box 40 is combined with the slide unit 110 to allow a combining protrusion 111*a* provided at the slide unit 110 to be inserted into a combining groove 41 of the storage box 40.

When the storage box 40 is combined with the slide unit 110, the slide unit 110 is guided along the cover rail 120 by sliding so that the storage box 40 may be inserted into and drawn from the storage chamber 20.

Since the sliding shelf 100 is combined with the lower portion of the storage box 40, the storage box 40 may be sufficiently drawn to the outside of the storage chamber 20 such that food, etc. stored inside the storage box 40 may be easily taken out and used.

Additionally, due to a structure in which the sliding shelf 100 is combined with the lower portion of the storage box 40, it is possible to directly store food, etc. in an upper portion of the sliding shelf 100 without combining the storage box 40 with the upper portion of the sliding shelf 100, and it is also possible to store food, etc. in the storage box 40 by combining the storage box 40 with the upper portion of the sliding shelf 100.

Next, a constitution of the sliding shelf will be described in detail.

As illustrated in FIGS. 1 to 8, the sliding shelf 100 includes the cover rail 120 combined with both sidewalls of the storage chamber 20, the slide unit 110 sliding along the cover rail 120, and a self-closing unit 130 which is combined with the slide unit 110 and transfers an elastic force in a direction in which the storage box 40 is inserted such that the storage box 40 may be easily closed even with only a small force.

The slide unit 110 includes a sliding part 111 combined with the lower portion of the storage box 40, and a slide rail 113 provided on both sides of the sliding part 111 to slide along the cover rail 120.

The combining protrusion 111*a* which protrudes upwardly is provided at an upper portion of both sides of a front of the sliding part 111 for combining the storage box 40 with the sliding part 111, and the combining groove 41, into which the combining protrusion 111*a* is inserted, is provided at a position corresponding to the combining protrusion 111*a* at the storage box 40.

As mentioned above, the cover rail 120 is combined with the combining unit 26, and guides the storage box 40 to be inserted into and drawn from the storage chamber 20 by sliding.

As illustrated in FIGS. 7 to 11, the self-closing unit 130 is separately provided at both sides of a lower portion of the sliding part 111, and includes a case 140 forming an exterior, an elastic unit 150 which is provided inside the case 140 and accumulates an elastic force when the storage box 40 is drawn and transfers the elastic force in a direction in which the storage box 40 is inserted when the storage box 40 is inserted, and an oil damper 160 which is combined with the elastic unit 150 and absorbs a shock which is generated when the storage box 40 is inserted.

The elastic unit 150 includes a slider 151 moved linearly inside the case 140, a rotator 153 rotatably combined with the slider 151, and an elastic member 155 of which both ends are respectively combined with the slider 151 and the case 140.

The slider 151 includes a rotation hole 151*a* in which a rotation axis 153*b* provided at the rotator 153 to be mentioned below is rotatably combined, a first fixing groove 151*b* in which the elastic member 155 is fixed, and a second fixing groove 151*c* in which the oil damper 160 is fixed.

The slider 151 is moved linearly together with the rotator 153 along a guide rail 141 to be mentioned below, and the elastic member 155 fixed at the first fixing groove 151*b* of the slider 151 is stretched through the linear movement such that the elastic member 155 may accumulate an elastic force.

The rotator 153 includes a protrusion 153*a* which protrudes in a downward direction of a lower portion of the rotator 153 and is received at the guide rail 141 such that the rotator 153 is guided along the guide rail 141, the rotation axis 153*b* which allows the rotator 153 to be rotatably combined with the slider 151, and a locking groove 153*c* which is provided to allow a locking member 123 provided at the cover rail 120 to be received and locked.

The protrusion 153*a* is provided at the lower portion of the rotator 153 to protrude toward the guide rail 141 and be moved along the guide rail 141 such that the rotator 153 is guided along the guide rail 141.

The rotation axis 153*b* is provided at an upper portion of the rotator 153 and is rotatably combined with the rotation hole 151*a* of the slider 151.

The rotator 153 is provided to be rotatable around the rotation axis 153*b* by the rotation axis 153*b* such that the rotator 153 is moved linearly within a certain section together with the slider 151 and then rotated.

The locking groove 153*c* is provided to allow the locking member 123 provided at the cover rail 120 to be locked such that the rotator 153, which is moved together with the storage box 40 when the storage box 40 is inserted or drawn, may be moved along the guide rail 141.

Since the locking member 123 provided at the cover rail 120 which is fixed to the combining unit 26 of the storage chamber 20 maintains a fixed status, the rotator 153 is moved along the guide rail 141 when the locking member 123 is locked to the locking groove 153*c* of the rotator 153 while the storage box 40 is inserted or drawn.

The elastic member 155 may be provided as a spring, and both ends of the elastic member 155 are respectively fixed to the case 140 and the slider 151.

Among the both ends of the elastic member 155, one end fixed to the case 140 maintains a fixed status, and the other end fixed at the slider 151 is moved together with the slider 151 when the slider 151 is moved linearly, and is stretched, then returned to its original state, and transfers an elastic force to the storage box 40.

The case 140 is provided at the lower portion of the sliding part 111 and forms an exterior, and the elastic unit 150 and the oil damper 160 are received inside the case 140.

The guide rail 141 which receives and moves the protrusion 153*a* of the rotator 153, a guide part 143 which is a path through which the locking member 123 is moved together with the rotator 153, a fixer 145 which fixes the elastic member 155, a first receiving part 147 which receives the elastic member 155, and a second receiving part 149 which receives the oil damper 160 are provided inside the case 140.

As mentioned above, the guide rail 141 is provided to receive the protrusion 153*a* provided at the rotator 153 to be moved, and guides the rotator 153 and the slider 151.

The guide rail 141 includes a straight route 141*a* which guides the rotator 153 to be linearly movable in forward and backward directions, and a locking part 141*b* provided at one end of the straight route 141*a* to allow the rotator 153 to be rotated and fixed.

Operations of the rotator 153 which is guided along the guide rail 141 and moved linearly and rotated will be described below.

The guide part 143 is provided to be parallel to the straight route 141*a* of the guide rail 141 and guides the locking member 123, which is locked to the locking groove 153*c* of the rotator 153 and moved together with the rotator 153, to be linearly movable.

The oil damper 160 includes a body part 161, the inside of which is filled with oil, which is received in the second receiving part 149 of the case 140, and a moving unit 163 which is received inside the body part 161 and one end of which is fixed at the second fixing groove 151*c* of the slider 151.

Since one end of the moving unit 163 is fixed to the slider 151, the moving unit 163 is moved together with the slider 151.

Since the slider 151 is moved together with the storage box 40 in the same direction as the storage box 40 when the storage box 40 is inserted or drawn, the moving unit 163 is also inserted into the body part 161 when the storage box 40 is inserted, and the moving unit 163 is drawn from the inside to the outside of the body part 161 when the storage box 40 is drawn.

Since a shock is absorbed by oil filled in the body part 161 during the operation of the moving unit 163 being drawn from and inserted into the body part 161, a rapid movement of the elastic unit 150 which is caused by an elastic force of the elastic unit 150 when the storage box 40 is inserted may be prevented.

Therefore, a shock, which is generated by the elastic force of the elastic unit 150 while the storage box 40 is rapidly inserted when the storage box 40 is inserted, is absorbed such that noise may be decreased.

A locking tab 149*a* is provided at the second receiving part 149 such that the body part 161 maintains a state of being received inside the second receiving part 149 of the case 140, and only the moving unit 163 is moved together with the slider 151, and is inserted into and drawn from the body part 161.

The locking tab 149*a* is provided to form a space through which the body part 161 is unable to pass and only the moving unit 163 may pass, and the body part 161 is locked to the locking tab 149*a* to prevent movement when the moving unit 163 is moved together with the slider 151.

Next, referring to FIGS. 12 to 15, operations of the self-closing unit 130 when the storage box 40 is inserted or drawn will be described as follows.

As illustrated in FIG. 12, when the storage box 40 is inserted, the locking groove 153*c* of the rotator 153 is in a state of being locked to the locking member 123 provided at the cover rail 120.

Since the rotator 153 is not moved yet, the elastic member 155 maintains its original state before stretching, and the oil damper 160 also maintains the state in which the moving unit 163 is inserted into the body part 161.

As illustrated in FIG. 13, when the storage box 40 is drawn, since the locking member 123 is locked to the locking groove 153*c* of the rotator 153 while the storage box 40 is drawn, the rotator 153 moved together with the storage box 40 is moved backward along the straight route 141*a* of the guide rail 141 by the locking member 123 fixed to the cover rail 120.

Since the protrusion 153*a* provided at the rotator 153 is moved along the straight route 141*a* while being received in the straight route 141*a*, the rotator 153 is also moved along the straight route 141*a* without separating from the straight route 141*a*.

When the rotator 153 is moved backward along the straight route 141*a*, the locking member 123 is moved together with the rotator 153 along the guide part 143 maintaining the state of the rotator 153 being locked to the locking groove 153*c*.

When the rotator 153 is moved backward along the straight route 141*a*, since the slider 151 combined with the rotator 153 is moved together with the rotator 153, the elastic member 155 combined with the slider 151 is stretched and accumulates an elastic force.

Additionally, the moving unit 163 of the oil damper 160 is moved together with the slider 151 and drawn from the body part 161.

Since the rotator 153 moved along the straight route 141*a* is rotatably combined with the slider 151 by the rotation axis 153*b*, the protrusion 153*a* is rotated around the rotation axis 153*b* while moving to the locking part 141*b* provided at the end of the straight route 141*a*.

When the rotator 153 is locked to the locking part 141*b* and fixed, the elastic member 155 is stretched no more and maintains the stretched state, and the moving unit 163 of the oil damper 160 is drawn no further from the body part 161.

As illustrated in FIG. 14, when the storage box 40 is being drawn in the state of the rotator 153 being locked to the locking part 141*b*, since the locking member 123 is unlocked from the locking groove 153*c* when the rotator 153 is rotated and locked to the locking part 141*b* in the state of the rotator 153 being locked to the locking part 141*b*, only the locking member 123 unlocked from the locking groove 153*c* is moved along the guide part.

As illustrated in FIG. 15, when the storage box 40 is inserted, the locking member 123 is moved forward along the guide part 143 and locked to the locking groove 153*c* of the rotator 153.

When the locking member 123 is locked to the locking groove 153*c* of the rotator 153, the rotator 153 is rotated around the rotation axis 153*b* and unlocked from the locking part 141*b*.

The rotator 153 is unlocked from the locking part 141*b* and moved forward together with the locking member 123 along the straight route 141*a* to return to the state illustrated in FIG. 10.

When the rotator 153 is moved forward along the straight route 141*a*, the rotator 153 is moved forward by an elastic force of the stretched elastic member 155, and thus the storage box 40 may be easily inserted into the storage chamber 20 even though a user does not push with great force.

When the rotator 153 is moved forward by an elastic force of the elastic member 155, the moving unit 163 of the oil damper 160 is inserted into the body part 161.

When the moving unit 163 is inserted into the body part 161, since a shock is absorbed by oil filled inside the body part 161, a shock of the storage box 40 inserted by the elastic force may be absorbed.

As above, although a refrigerator is described focusing on the particular shape and directions with reference to the attached figures, it should be appreciated by those skilled in the art that changes may be made in these embodiments without departing from the principles and spirit of the invention, the scope of which is defined in the claims and their equivalents.

The invention claimed is:

1. A refrigerator comprising:

a main body;

a storage chamber provided inside the main body, and including an open front surface and at least two sidewalls;

a sliding shelf configured to be slidably inserted into and drawn out of the storage chamber through the open front surface, and including a sliding part having a shelf surface configured to support a bottom surface of a removable storage box and configured to directly support a food item when the removable storage box is removed from the sliding shelf; and a combining unit provided at the at least two sidewalls of the storage chamber to be combined with the sliding shelf, wherein the sliding shelf includes:

a cover rail combined with the combining unit and configured to guide the removable storage box, and including a locking member having a first protrusion that projects towards a center of the sliding shelf and a second protrusion that projects from the first protrusion up towards a bottom of the shelf surface;

a slide rail provided at the sliding part to slide along the cover rail; and a self-closing unit combined with the sliding part and provided on the bottom of the shelf surface and adjacent to a side of the cover rail facing the center of the sliding shelf, and including a locking groove on a bottom surface of the self-closing unit that is configured to receive the second protrusion of the locking member to accumulate an elastic force when the sliding shelf is drawn out of the storage chamber and transfer the elastic force in a direction in which the sliding shelf is inserted when the sliding shelf is inserted into the storage chamber, and provided with an oil damper which absorbs a shock which is generated by the elastic force when the sliding shelf is inserted into the storage chamber.

2. The refrigerator according to claim 1, wherein the combining unit is integrally provided at the at least two sidewalls of the storage chamber such that the cover rail is fitted by sliding.

3. The refrigerator according to claim 2, wherein the cover rail includes a fastening hole into which a fastening member is inserted such that the cover rail is fastened to the combining unit by the fastening member after the cover rail is fitted into the combining unit.

4. The refrigerator according to claim 3, wherein a combining protrusion which protrudes upwardly is provided at an upper portion of both sides of a front of the sliding part for a combination of the storage box and the sliding part, and a combining groove, into which the combining protrusion is inserted, is provided at a position corresponding to the combining protrusion at the storage box.

5. The refrigerator according to claim 4, wherein the storage box is configured to be combined with an upper portion of the sliding part after the cover rail is combined with the combining unit.

6. The refrigerator according to claim 1, wherein the self-closing unit includes a case separately provided at both sides of a lower portion of the sliding part and configured to form an exterior, an elastic unit which is provided inside the case and accumulates the elastic force when the sliding shelf is drawn out of the storage chamber and transfer the elastic force in a direction in which the storage box is inserted when the storage box is inserted into the storage chamber, and the oil damper combined with the elastic unit.

7. The refrigerator according to claim 6, wherein the elastic unit includes a slider moved linearly inside the case, a rotator rotatably combined with the slider, and an elastic member of which both ends are respectively combined with the slider and the case.

8. The refrigerator according to claim 7, wherein the locking member is locked to the rotator when the storage box is inserted into and drawn out of the storage chamber such that the rotator is moved linearly in a direction opposite to a moving direction of the storage box.

9. The refrigerator according to claim 8, wherein a fixer of which one end of the elastic member is fixed, a first receiving part in which the elastic member is received, a second receiving part in which the oil damper is received, a guide rail which guides the rotator, and a guide part which is provided to be parallel with the guide rail and guides the locking member to be moved linearly are provided inside the case.

10. The refrigerator according to claim 9, wherein the guide rail includes a straight route which guides the rotator to be moved linearly in forward and backward directions, and a locking part which is provided at one end of the straight route such that the rotator is rotated and fixed.

11. The refrigerator according to claim 10, wherein the rotator includes a protrusion which protrudes toward the guide rail and is received in the guide rail such that the rotator is guided along the guide rail, and a rotation axis which allows the rotator to be rotatably combined with the slider.

12. The refrigerator according to claim 11, wherein the slider includes a rotation hole in which the rotation axis is rotatably combined, a first fixing groove in which the elastic member is fixed, and a second fixing groove in which the oil damper is fixed.

13. The refrigerator according to claim 12, wherein the oil damper includes a body part an inside of which is filled with oil and which is received in the second receiving part, and a moving unit which is received inside the body part, fixed at the second fixing groove and moved linearly together with the slider, and inserted into and drawn from the body part, wherein a locking tab is provided in the second receiving part so as to fix the body part to prevent a movement of the body part.

14. The refrigerator according to claim 13, wherein the self-closing unit is moved together with the storage box in a direction in which the storage box is drawn from the storage chamber and the rotator is locked to the locking member and moved along the straight route such that the elastic member is stretched, during a process of removing the storage box.

15. The refrigerator according to claim 14, wherein the rotator is moved along the straight route together with the slider and rotates around the rotation axis to be locked to the locking part, the elastic member maintains a stretched state when the rotator is locked and fixed at the locking part, and the locking member is moved along the guide part such that the storage box is completely drawn while the locking member is separated from the locking groove.

16. The refrigerator according to claim 15, wherein the self-closing unit is moved together with the storage box in the direction in which the storage box is inserted into the storage chamber, and the rotator is locked to the locking member while the locking member is moved along the guide part such that the rotator is rotated around the rotation axis and is released from the locking part, during a process of inserting the storage box.

17. The refrigerator according to claim 16, wherein the rotator is moved along the straight route and the elastic force of the elastic member is transferred to the storage box in the direction in which the storage box is inserted into the storage chamber such that the storage box is inserted, when the rotator is released from the locking part.

18. The refrigerator according to claim 17, wherein the oil damper absorbs a shock which is generated when the storage box is inserted in such a manner that the moving unit fixed to the slider is moved together with the slider and drawn to an outside of the body part when the storage box is drawn, and the moving unit is moved together with the slider and inserted into the body part when the storage box is inserted.

19. A refrigerator comprising:

a main body;

a storage chamber provided inside the main body, and including an open front surface and at least two sidewalls;

a cover rail combined with the at least two sidewalls of the storage chamber and configured to guide a removable storage box, and including a locking member having a first protrusion that projects away from a sidewall of the at least two sidewalls of the storage chamber and a second protrusion that projects from the first protrusion up towards a top of the storage chamber;

a slide unit configured to slide along the cover rail, configured to be slidably inserted into and drawn out of the storage chamber through the open front surface, and including a sliding part having a shelf surface configured to support a bottom surface of the removable storage box and configured to directly support a food item when the removable storage box is removed from the slide unit; and a self-closing unit which is combined with the slide unit and provided on a bottom of the shelf surface and adjacent to a side of the cover rail facing a center of the shelf surface, and including a locking groove on a bottom surface of the self-closing unit that is configured to receive the second protrusion of the locking member to transfer an elastic force in a direction in which the slide unit is inserted into the storage chamber, wherein the self-closing unit includes:

an elastic unit which accumulates an elastic force when the slide unit is drawn; and an oil damper which accumulates a damping force when the elastic unit accumulates the elastic force, wherein the accumulated elastic force and damping force act on the slide unit at the same time when the slide unit is inserted such that the slide unit is inserted by the elastic force and a shock, which is generated on the slide unit when the slide unit is inserted, is absorbed by the damping force.

20. The refrigerator according to claim 19, wherein the slide unit includes a slide rail provided in the sliding part to slide along the cover rail.

21. The refrigerator according to claim 19, wherein the self-closing unit further includes a case separately provided at both sides of a lower portion of the sliding part and configured to form an exterior, and the elastic unit and the oil damper are received inside the case.

22. The refrigerator according to claim 21, wherein the elastic unit includes a slider moved linearly inside the case, a rotator rotatably combined with the slider, and an elastic member of which both ends are respectively combined with the slider and the case.

23. The refrigerator according to claim 22, wherein the locking member is locked to the rotator when the slide unit is inserted or drawn such that the rotator is moved linearly in a direction opposite to a moving direction of the storage box.

24. The refrigerator according to claim 23, wherein a fixer of which one end of the elastic member is fixed, a first receiving part in which the elastic member is received, a second receiving part in which the oil damper is received, a guide rail which guides the rotator, and a guide part which is provided to be parallel with the guide rail and guides the locking member to be moved linearly are provided inside the case.

25. The refrigerator according to claim 24, wherein the guide rail includes a straight route which guides the rotator to be moved linearly in forward and backward directions, and a locking part which is provided at one end of the straight route such that the rotator is rotated and fixed.

26. The refrigerator according to claim 25, wherein the rotator includes a protrusion which protrudes toward the guide rail and is received in the guide rail such that the rotator is guided along the guide rail, and a rotation axis which allows the rotator to be rotatably combined with the slider.

27. The refrigerator according to claim 26, wherein the slider includes a rotation hole in which the rotation axis is rotatably combined, a first fixing groove in which the elastic member is fixed, and a second fixing groove in which the oil damper is fixed.

28. The refrigerator according to claim 27, wherein the oil damper includes a body part an inside of which is filled with oil and which is received in the second receiving part, and a moving unit which is received inside the body part, fixed at the second fixing groove and moved linearly together with the slider, and inserted into and drawn from the body part, wherein a locking tab is provided in the second receiving part so as to fix the body part to prevent a movement of the body part.

29. The refrigerator according to claim 28, wherein the self-closing unit is moved together with the storage box in a direction in which the storage box is drawn from the storage chamber, and the rotator is locked to the locking member and moved along the straight route such that the elastic member is stretched, during a process of removing the storage box.

30. The refrigerator according to claim 29, wherein the rotator is moved along the straight route together with the slider and rotates around the rotation axis to be locked to the locking part, the elastic member maintains a stretched state when the rotator is locked and fixed at the locking part, and the locking member is moved along the guide part such that the storage box is completely drawn while the locking member is separated from the locking groove.

31. The refrigerator according to claim 30, wherein the self-closing unit is moved together with the storage box in the direction in which the storage box is inserted into the storage chamber, and the rotator is locked to the locking member while the locking member is moved along the guide part such that the rotator is rotated around the rotation axis and is released from the locking part, during a process of inserting the storage box.

32. The refrigerator according to claim 31, wherein the rotator is moved along the straight route, and an elastic force of the elastic member is transferred to the storage box in the direction in which the storage box is inserted into the storage chamber such that the storage box is inserted, when the rotator is released from the locking part.

33. The refrigerator according to claim 32, wherein the oil damper absorbs a shock which is generated when the storage box is inserted in such a manner that the moving unit fixed to the slider is moved together with the slider and drawn to an outside of the body part when the storage box is drawn, and the moving unit is moved together with the slider and inserted into the body part when the storage box is inserted.

34. A refrigerator comprising:

a main body;

a storage chamber provided inside the main body, and including an open front surface and at least two sidewalls;

a cover rail combined with the at least two sidewalls of the storage chamber and configured to guide a removable storage box, and in which a locking member is provided that has a first protrusion that projects away from a sidewall of the at least two sidewalls of the storage chamber and a second protrusion that projects from the first protrusion up towards a top of the storage chamber;

a slide unit configured to slide along the cover rail, configured to be slidably inserted into and drawn out of the storage chamber through the open front surface, and including a sliding part having a shelf surface configured to support a bottom surface of the removable storage box and configured to directly support a food item when the removable storage box is removed from the slide unit;

an elastic unit which is combined with the slide unit and provided on a bottom of the shelf surface and adjacent to a side of the cover rail facing a center of the shelf surface, and having a bottom surface in which a locking groove, which is locked to the second protrusion of the locking member when the slide unit is inserted or drawn, is provided to accumulate an elastic force when the locking member is locked to the locking groove while the slide unit is drawn, and transfer the elastic force to the slide unit when the locking member is locked to the locking groove while the slide unit is inserted; and an oil damper, which accumulates a damping force when the elastic unit accumulates the elastic force and absorbs a shock, which is generated on the slide unit by the elastic force, using the accumulated damping force when the elastic unit transfers the elastic force to the slide unit.

* * * * *